US008079484B2

(12) United States Patent
Wachsberg

(10) Patent No.: US 8,079,484 B2
(45) Date of Patent: Dec. 20, 2011

(54) BOTTLE AND CAP WITH ANTI-GLUG FEATURE

(75) Inventor: Richard Wachsberg, Concord (CA)

(73) Assignee: Rwachsberg Holdings, Inc., Concord, Ontario (CA)

( * ) Notice: Subject to any disclaimer, the term of this patent is extended or adjusted under 35 U.S.C. 154(b) by 981 days.

(21) Appl. No.: 11/936,953

(22) Filed: Nov. 8, 2007

(65) Prior Publication Data

US 2008/0110849 A1 May 15, 2008

(30) Foreign Application Priority Data

Nov. 10, 2006 (CA) ..... 2567706

(51) Int. Cl.

| | |
|---|---|
| ***B65D 23/10*** | (2006.01) |
| ***B65D 41/00*** | (2006.01) |
| ***B65D 51/04*** | (2006.01) |
| ***B67D 3/00*** | (2006.01) |

(52) U.S. Cl. ..... 215/235; 215/398; 220/837; 220/771; 222/556; 222/268

(58) Field of Classification Search ..... 220/669, 220/675, 771; 215/323, 235; 222/556–570
See application file for complete search history.

(56) References Cited

U.S. PATENT DOCUMENTS 3,251,514 A * 5/1966 Speicher ..... 222/468
4,550,862 A * 11/1985 Barker et al. ..... 222/109
4,804,119 A * 2/1989 Goodall ..... 222/468
4,890,770 A * 1/1990 Haga et al. ..... 222/109
5,207,356 A * 5/1993 Krall ..... 222/109
D385,196 S * 10/1997 Entrup ..... D9/543
5,862,929 A * 1/1999 Takeuchi et al. ..... 215/398

* cited by examiner

*Primary Examiner* — Robin Hylton
(74) *Attorney, Agent, or Firm* — Calfee, Halter & Griswold LLP

(57) ABSTRACT

A combination of bottle and cap for dispensing a liquid. The bottle includes a narrow neck and a hollow handle. The hollow interior of the handle communicates at its upper and lower end with the interior of the body, to permit a flow of air through the neck opening, via the interior of the handle, to a lower region within the interior of the container so as to minimize glugging during pouring. The cap comprises a cap body attachable to the neck of the bottle. The cap includes on its crown first and second openings, for dispensing liquid and intake of air, respectively. The cap is configured to attach to the container body so as to position the second opening generally facing the handle, while the first opening is opposed to the handle. During pouring, air flows into the second opening within the cap as liquid exits the first opening, with the inflowing air being channeled into the hollow handle interior with minimal interference with the outflowing liquid so as to introduce air into the interior of the body to displace the liquid being poured from the bottle.

14 Claims, 7 Drawing Sheets

BOTTLE AND CAP WITH ANTI-GLUG FEATURE

PRIORITY

This application claims priority to Canadian Patent Application No. 2,567,706, filed on Nov. 10, 2006, the contents of which are hereby incorporated by reference.

FIELD OF THE INVENTION

The invention relates to hand-held containers for holding a pourable liquid, and in particular to narrow-necked containers which include a means to introduce air into the interior during pouring in order to reduce the glugging that normally occurs if liquid is poured too rapidly, in particular if the liquid is highly viscous.

BACKGROUND OF THE INVENTION

Bottles and other liquid-holding containers are often provided with a relatively narrow neck and mouth, making them convenient to handle and pour liquid therefrom. However, they can suffer the drawback of "glugging" when the user pours liquid too rapidly. This occurs when the outgoing liquid blocks the passage of incoming air, resulting in irregular flow, splashing and slow pouring. This problem tends to be more pronounced with larger containers which hold relatively large liquid volumes such as those which hold greater than one liter, and in particular if the liquid is relatively viscous, such as liquid soap or the like.

The prior art includes various anti-glug features incorporated into container designs to promote more rapid and splash-free pouring. In a typical example of a prior art arrangement, a container or pail may include a primary opening comprising pour spout or opening within its lid, and a secondary, typically smaller, opening within the lid or upper portion of the container in a position spaced apart from the main opening. The secondary opening permits the intake of air as liquid is poured through the primary opening. This arrangement requires the user to manipulate both of the primary and secondary closures. As a result, there is a greater chance that one of the closures will be left unopened or not properly closed after use. As well, many popular container shapes do not readily accommodate the widely spaced apart secondary opening required for this design, for example containers having an elongate, narrow neck and sloping shoulders. In certain other arrangements, a narrow-necked bottle may be provided with a cap having two relatively closely spaced openings. However, prior art arrangements of this type tend not to be very effective, since the close spacing of the two openings in these arrangements has been ineffective at preventing glugging. For example, one such prior art container consists of a bottle or jug having a flip-open cap which includes a primary opening or spout for dispensing liquid and a secondary opening spaced close to the primary opening to permit air to enter the container during pouring. However, since the container has a narrow mouth, the dual openings are of necessity relatively close together, which results in glugging if the liquid is poured too rapidly.

Existing containers, in particular those with narrow necks and mouths, are intrinsically limited in the spacing that is possible between dual openings within the container opening or cap.

Accordingly, it is desirable to provide a simple container that may be readily fabricated by conventional methods, having effective anti-glug features. Such a container is particularly useful for more viscous liquids such as liquid soaps, and is specifically adapted for use with a moulded narrow-necked plastic container having a screw top cap with a flip-open covering.

SUMMARY OF THE INVENTION

An object of the present invention is to provide a bottle and cap which may be of the type having an elongate neck and a narrow mouth, with features that prevent or minimizes glugging while liquid is being poured from the bottle, in particular if the bottle is not angled overly steeply nor fully inverted during pouring.

In one aspect, the invention relates to a combination of bottle and cap, the bottle comprising a body with an upstanding neck for receiving a removable cap. The body includes an elongate, vertically-oriented hollow handle having upper and lower ends, the upper end joining the body at or adjacent to the neck, with the lower portion adjoining the body at a lower region of the body. The handle is spaced apart from the body, to permit the user to easily grip the handle. The hollow interior of the handle forms an air conduit which communicates at its upper and lower end with the interior of the body, to permit a flow of air through the neck opening, via the interior of the handle, to a lower region of the interior of the container. The hollow handle thus effectively forms an air channel leading from the bottle neck or adjacent thereto, terminating at a lower region of the bottle interior.

The size of the bottle is in essence a design choice and is not intended to limit the scope of the invention, although it is contemplated that the container may have an interior volume of between one and two gallons, preferably about 1.5 gallons. The container body may be rigid or semi-rigid, for example, comprising a conventional moulded plastic.

The cap preferably fastens to the body neck via a conventional screw threading, although it is preferable that the threads are pitched relatively steeply so as to permit reasonably precise positioning of the cap relative to the body when screwed thereto. Alternatively, the cap may be fastened by other means or may be non-removable from the body, for example, with the bottle and cap being moulded as a single structure, although it is contemplated that in most cases the cap will be removable. The cap may comprise a generally tubular skirt, the wall of which is preferably internally screw-threaded for mating with external threads on the bottle body. A crown partially covers the cap body and optionally a removable or openable cap cover is provided, such as a flip open cover which covers the crown when closed. The cover is optional but it is expected that for most uses the cover will be provided. Preferably, the cap cover is joined to the cap body via a flexible strip which hinges the cover to the body so as to permanently join the cover to the body to prevent the user from mislaying the cover. The cover may snap-lock to the cap body so as to effectively seal the bottle. The crown which partly covers the upper end of the cap includes first and second openings, for dispensing liquid and permitting an intake of air, respectively, during pouring. The first opening is preferably at least partly surrounded by an upstanding wall to channel the flow of liquid during pouring. The second opening may consist of a partially annular-shaped opening which partly surrounds the first opening. The second opening is preferably semi-annular, i.e., consisting of approximately a curved slot extending circumferentially approximately 180 degrees. Preferably, the first and second openings merge together, for example by including a channel within the crown between the first and second openings. The channel may be located at the base of a gap within the upstanding wall. The cover effectively seals both the first and second openings when closed.

The cap is configured for attachment to the container body so as to position the second opening generally adjacent to the handle, while the first opening is opposed to the handle to form a pour spout for the liquid. For example, if the cap fastens to the body by a screw-threaded attachment, the threads may be pitched reasonably steeply so as to permit the cap to be consistently positioned with a reasonable degree of precision when screwed to the bottle. When thus positioned, the second opening is close to the upper end of the air conduit opening from the handle into the bottle. The second opening effectively forms an air inlet through which air enters as liquid exits the first opening during pouring. The incoming air is channeled into the hollow handle interior with minimal interference with the outflowing liquid.

According to another aspect, the bottle body includes recesses to enhance the user's grip on the bottle. Preferably, a face of the bottle opposed to the handle includes is scalloped inwardly with a horizontally disposed recess extending across the face of the bottle adjacent the lower edge of the bottle. On or more additional recesses may be provided on the side faces of the bottle on either side of the scalloped recess.

DETAILED DESCRIPTION OF THE DRAWINGS

DETAILED DESCRIPTION

Figure 1:
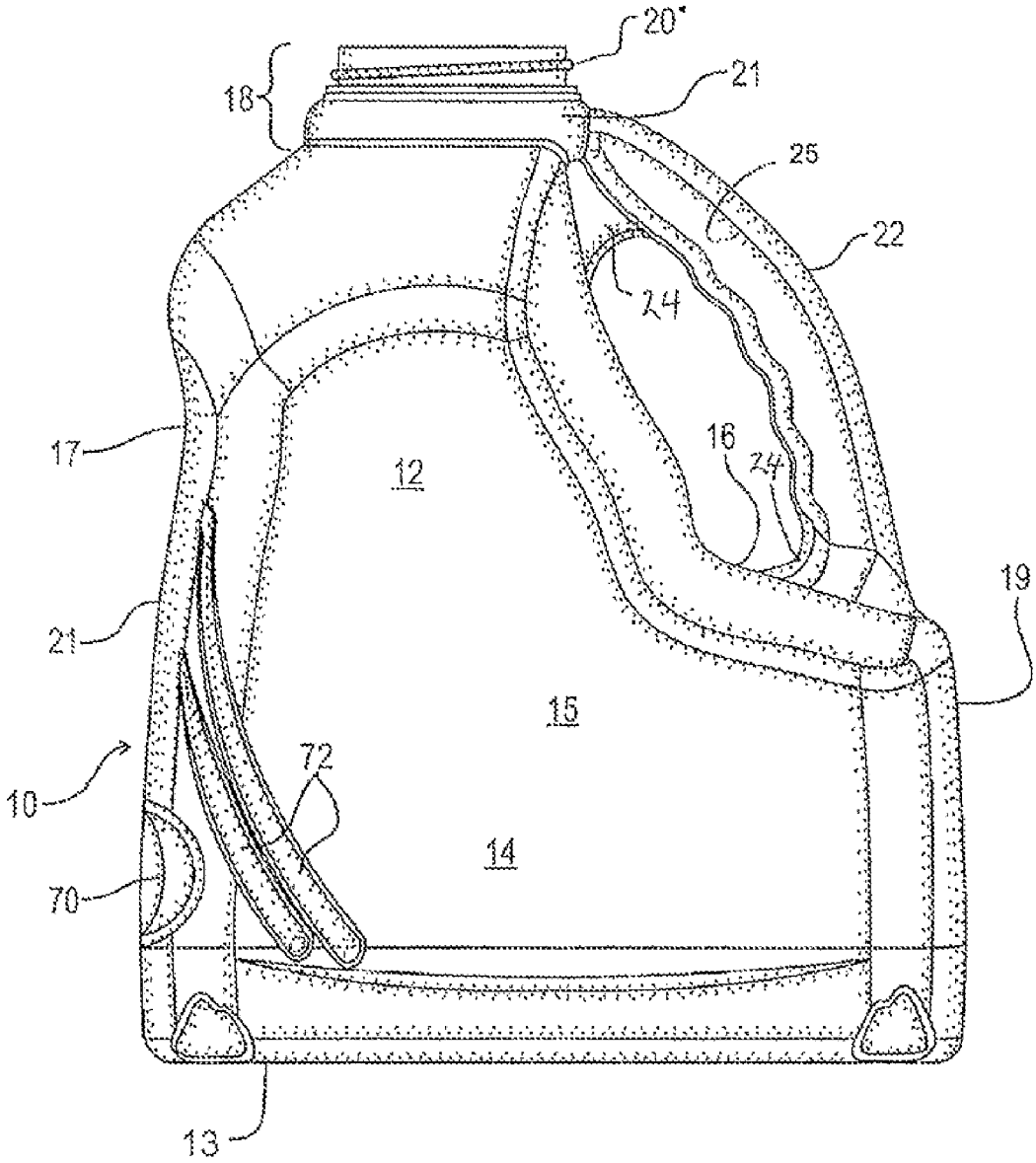
FIG. 1 is a side elevational view of the bottle according to the present invention, with the cap removed.

Referring to the figures, with particular reference to FIG. 1, the bottle 10 comprises moulded plastic which may comprise any conventional, suitably rigid or semi-rigid plastic, having a hollow interior for holding a liquid. For ease of description, the bottle is arbitrarily divided into upper and lower regions 12 and 14 respectively. The upper region 12 is inwardly-stepped from the lower region 14 at a shoulder 16 so as to provide a cutaway portion or recess on one side of the bottle to accommodate the user's hand when gripping the handle, described below. The upper region 12 tapers inwardly towards an elongate upstanding neck 18. The upper portion of the neck having external screw threads 20. The collar 21 is larger in diameter than the neck 18; since the air passage, described below, communicates with the bottle interior at the collar 21, the increased diameter of the collar serves to improve airflow characteristics. The lower portion of the neck 18 comprises a collar 21 which is non-screw threaded. The neck opens at a mouth 23. The bottle 10 comprises a base 13, opposed side faces 15 and 17, a rear face 19 which includes the shoulder 16, and an opposed front face 21.

A handle 22 is integral with the bottle 10. The handle 22 is generally elongate and upstanding from the shoulder 16, curving inwardly towards the body 10 to join the collar 21. The handle 22 extends from the rear face 19 of the body 10. The grippable region of the handle 22 is spaced apart from the bottle, to permit the user to grip the handle by wrapping his or her fingers fully around the handle. Gusset-like webs 24 provide structural support for the handle 22 filling part of the space between the handle and body where the handle 22 joins the bottle.

Figure 8:
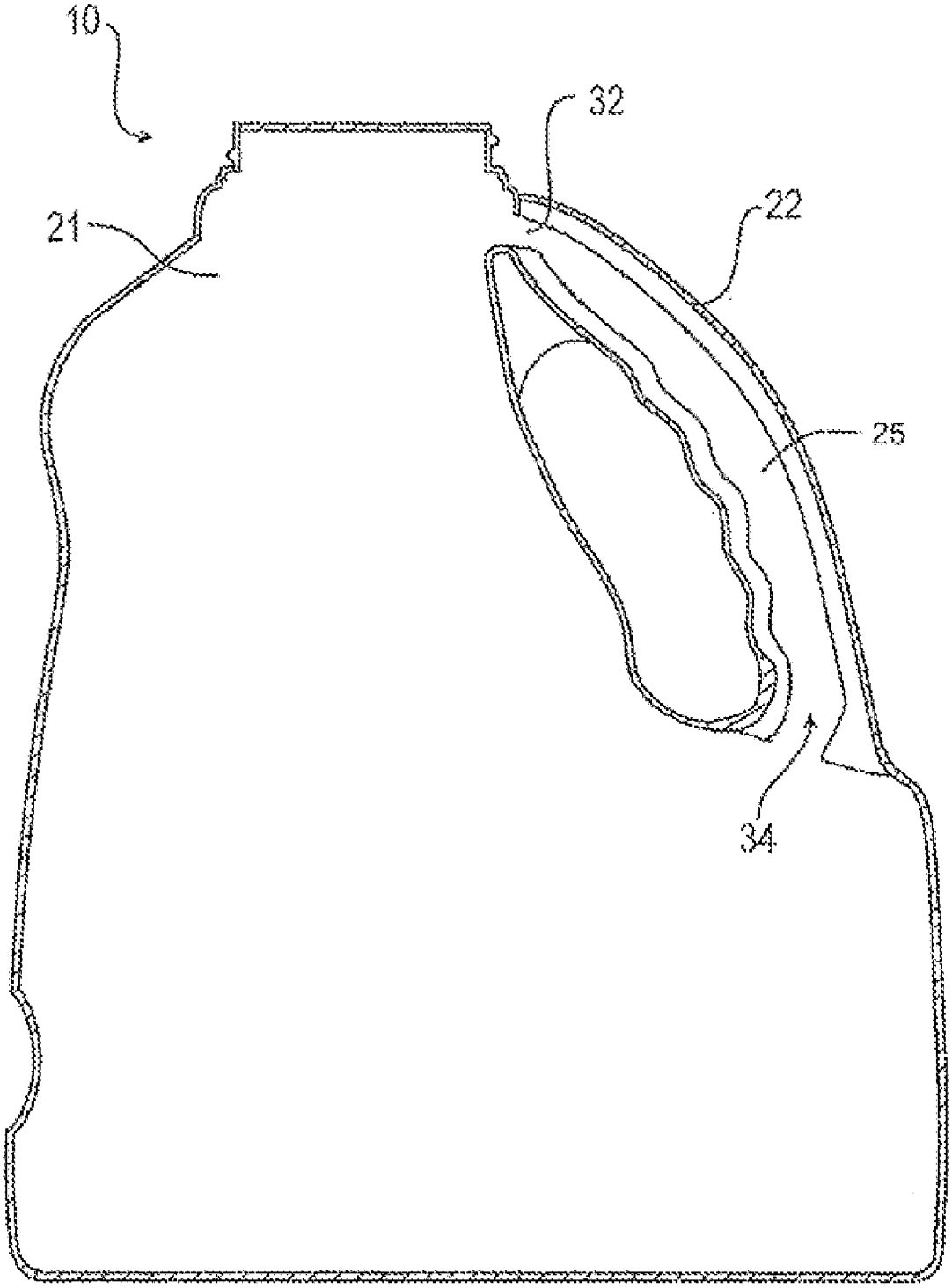
FIG. 8 is a cross-sectional view along line 8-8 of FIG. 7, showing the interior of the bottle.
Figure 9:
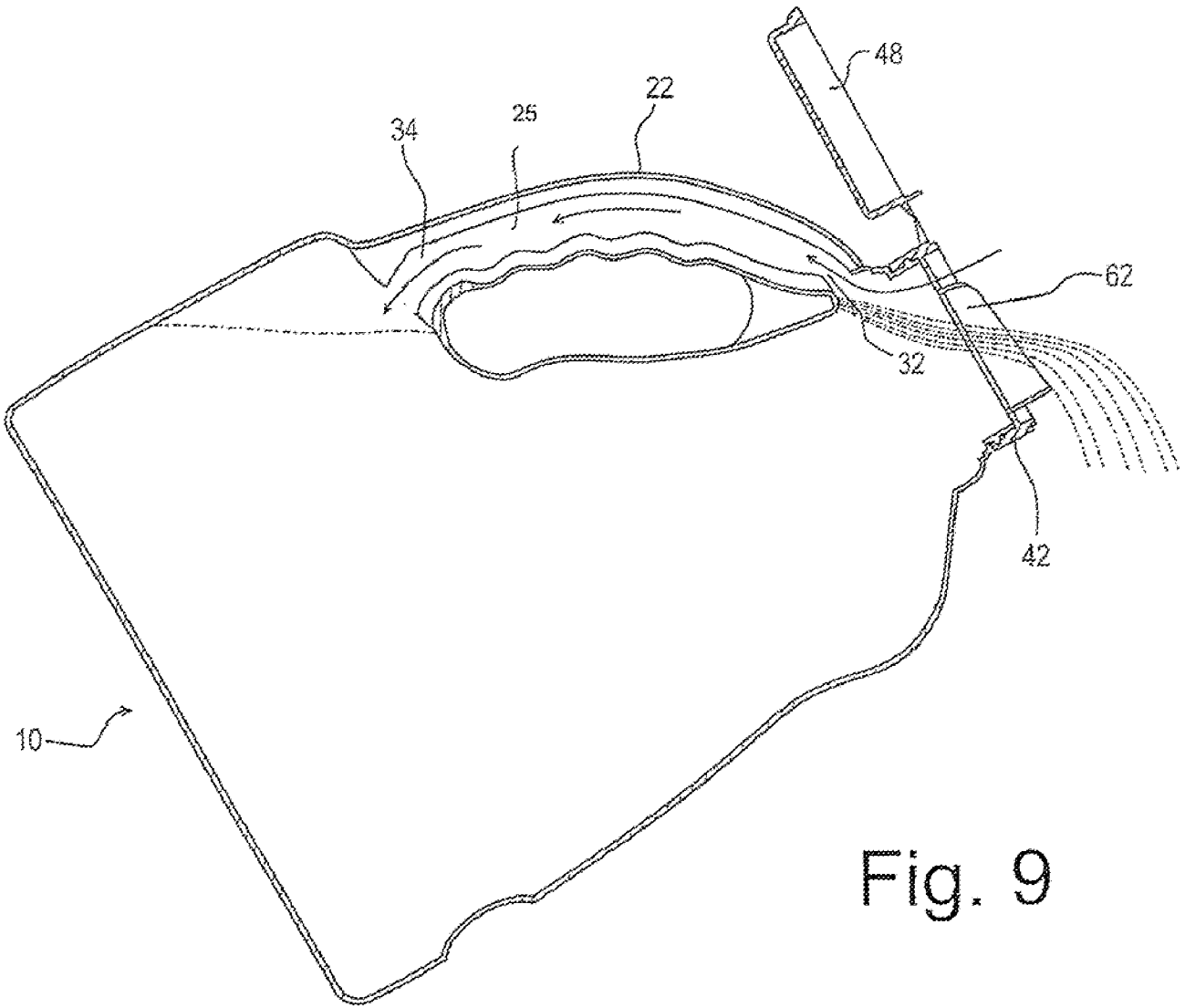
FIG. 9 is a further cross-sectional view as in FIG. 8, showing the bottle at an angle with liquid being poured from the spout.

As seen in FIGS. 8 and 9, the handle 22 has a hollow interior, forming a bore 25 communicating with the bottle interior at both upper and lower ends of the handle via upper and lower internal passages 32 and 34 respectively. The handle interior forms a continuous air passageway leading from the bottle neck or adjacent thereto, into a lower portion of the bottle. Conveniently, the handle 22 and body 10 are integrally moulded as a single unit. The interior communication between handle and container body permits a flow of air to pass from the interior of the neck directly into the lower interior region of the body, via the hollow handle interior, thereby by-passing an upper portion of the body 10 so as to permit liquid to flow out of the bottle in an unobstructed fashion.

In order to minimize glugging, the passage 32 is configured to minimize liquid entry during pouring. For this purpose, the passage 32 communicates with the collar 21, which is outwardly stepped from the upper region of the neck 18, thereby assisting in maintaining the passage 32 free of obstruction during pouring. Liquid entry into the passage 32 also tends to be minimized during pouring by its location at or near the air inlet within the cap, described below, which permits the opening 32 to remain clear of liquid being poured from the bottle when the bottle is tilted at a suitable angle for pouring. Thus, when the bottle is canted at a normal pouring angle (not overly inverted), and provided that the liquid level within the bottle 10 provides at least a small amount of headspace above the liquid level, the passage 32 will remain clear of the liquid and glugging is minimized. Preferably, the passages 32 and 34 have a restricted diameter relative to the internal bore within the handle 22.

The cap 40 is seen in more detail in FIGS. 3 through 6. The cap comprises a cap body 42, having a substantially tubular skirt 44. The interior of the wall 44 is screw-threaded for mating with the screw-threads 20 of the bottle body. The upper surface of the cap body 42 is partially covered with a crown 46, which will be described in more detail below. The cap is selectively covered with an openable friction fit lid 48, permanently joined to the cap body 42 by a flexible hinge 50. As is conventional in the art, the hinge 50 comprises a pair of spaced-apart bridging members having a thinned flex region 52. The hinge 50 comprises a flexible, resilient material. Conveniently, the entire cap 40 is moulded as a single unit. The lid 48 snap-locks to the cap body 42 to provide a liquid and air-tight seal. Removal of the lid is facilitated by a protruding ledge, which permits the user to open the lid. The lid 48 covers the entire crown including both openings therein, which are described below.

Figure 3:
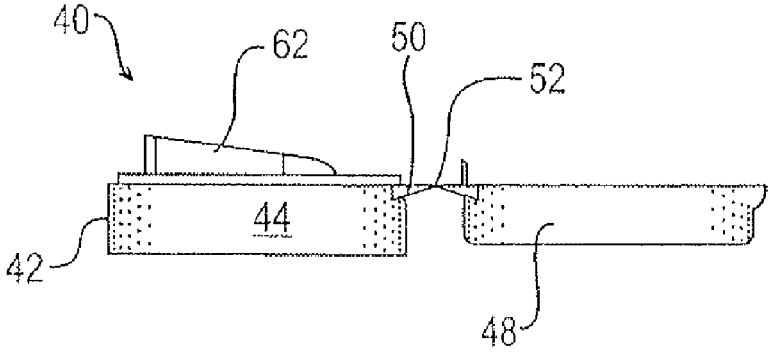
FIG. 3 is a side elevational view of the cap, in the open position.
Figure 4:
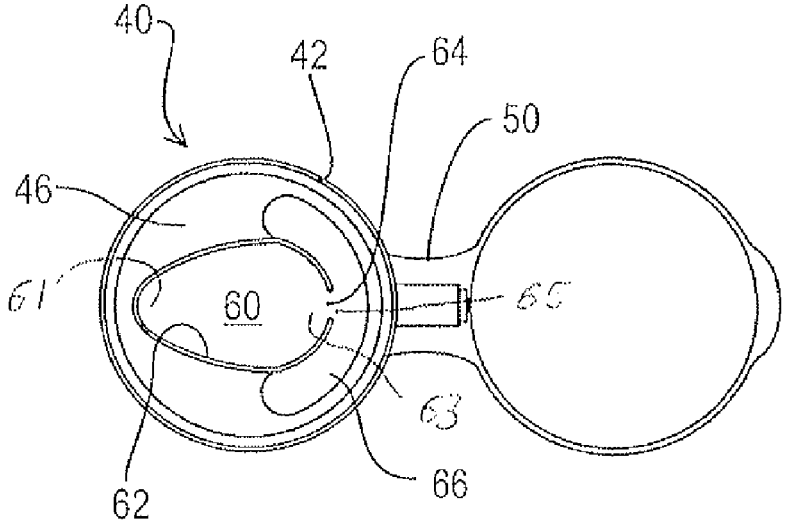
FIG. 4 is a top plan view of the cap, in open position.
Figure 5:
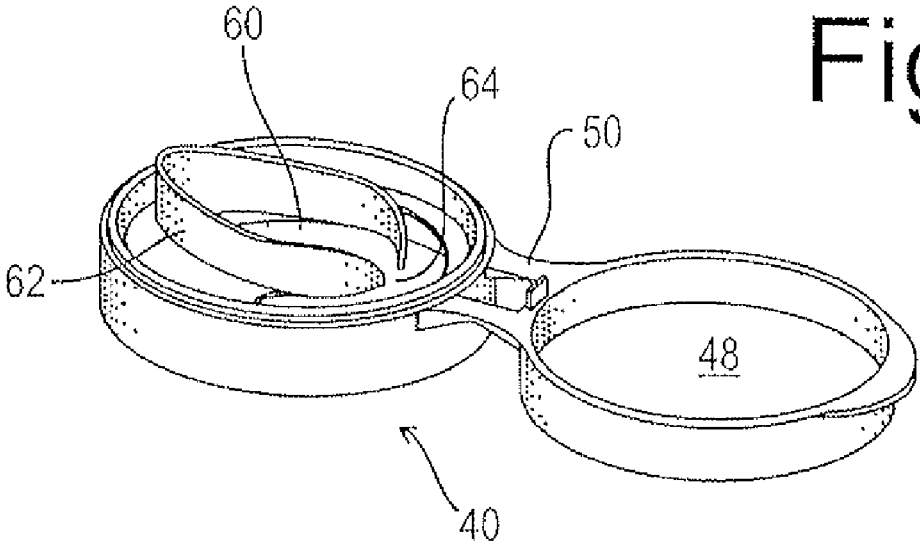
FIG. 5 is a perspective view of the cap, in the open position.
Figure 6:
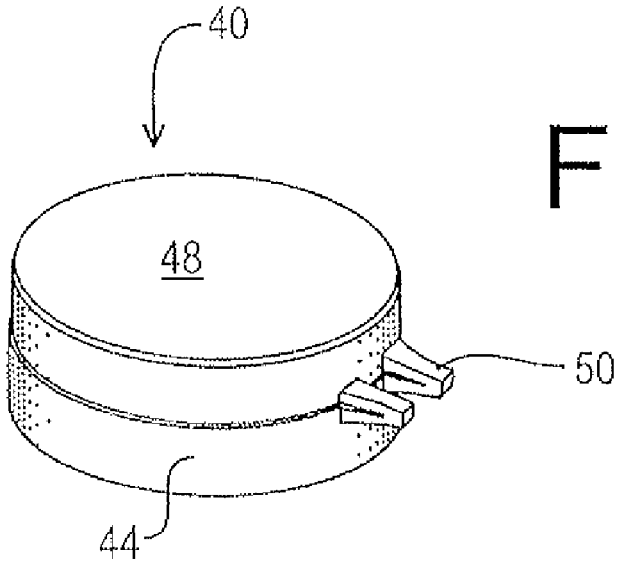
FIG. 6 is a perspective view of the cap in the closed position.

Turning to the cap body 42, this includes a first opening which forms a pour spout 60 centrally disposed within the crown 46. The pour spout 60 comprises a generally oval opening, the opposing sides of which preferably taper inwardly towards a first end 61 to facilitate pouring. The pour spout 60 is substantially, but not fully, encircled by a low wall 62, extending generally upwardly from the crown 46 when the bottle is upright. The wall 62 slopes upwardly towards the first end 61 of the spout, and slopes downwardly towards the opposed second end 63 of the spout, as seen in FIG. 3. The first end 61 is located at a position directly opposed to the handle 22 when the cap is attached to the bottle in its normal aligned position, and thereby forms the spillover region for liquid being poured from the bottle. The wall 62 at this location forms an effective lip to assist in pouring. At the second end 63, the wall 62 includes a gap 64 formed by opposing ends of the wall 62, which approach each other but do not meet in a complete oval.

A second opening 66 within the crown 46 is provided, comprising a partially annular passageway in the shape of a curved slot in the shape of a semi-circular channel having a circumference of approximately 180 degrees. The second opening 66 surrounds the second end 63 of the spout 60.

The first and second openings 60 and 66 communicate with each other via a channel 65, which passes through the gap 64. The effect of channel 65, combined with the curving shape of the second opening 66 is to permit the user to more precisely control the pouring of liquid so as to ensure that liquid is poured only through the pour spout 60. If the bottle is tilted too sharply, the liquid level within the cap will rise above the level of the channel 65 and start to exit through the lower parts of the curved opening 66. The upper part of the opening 66 will still be left unobstructed for air to flow therein. However, the user will be given a strong visual cue to ease off on the pouring angle, so as ensure that the second opening remains unobstructed of liquid.

Optionally, the opening 66 may vary from the approximately 180 degree curvature shown herein. However, it is preferably that it at least partially surrounds the second end 63 of the pour spout 60.

In operation, as liquid is poured from the bottle it flows through the spout 60. The curved opening 66 is generally left unobstructed by liquid during normal pouring. Since the cap 40 is positioned on the bottle so as to orient the second opening 66 adjacent to the passage 32, air will tend to be drawn into the opening 66, through the passage 32 and into the lower region 14 of the bottle 10, via the interior bore within the handle 22. This simultaneous outflow of liquid and inflow of air prevents or minimizes glugging during the pouring of liquid, in particular when pouring relatively viscous liquids. However, it is to be understood that glugging may still occur if the bottle is angled too steeply or if it is fully inverted during pouring. Rather, the bottle may be tilted at a reasonably steep angle, but if glugging occurs the user should reduce the angle. The precise angle of pouring will depend in part on the fill level of the bottle.

The mating bottle and cap screw threads are pitched at a relatively steep angle so as to provide reasonably precise positioning and alignment of the cap on the bottle when threaded thereon. Thus, when snugly threaded onto the bottle, the cap will be aligned with minimal scope for mis-alignment such that the hinge portion 50 of the cap faces the handle 22 and the first end of the spout 60 faces the front face 21 of the bottle, directly away from and opposed to the handle 22. When thus aligned, the opening 66 is proximate to the interior opening of the handle 22 such that air entering the opening 66 will tend to flow into the bore 25 with minimal blockage by the outgoing liquid. Air thus may directly enter the lower region 14 of the bottle 10, so as to minimize the liquid blockages that generate glugging during pouring.

Figure 2:
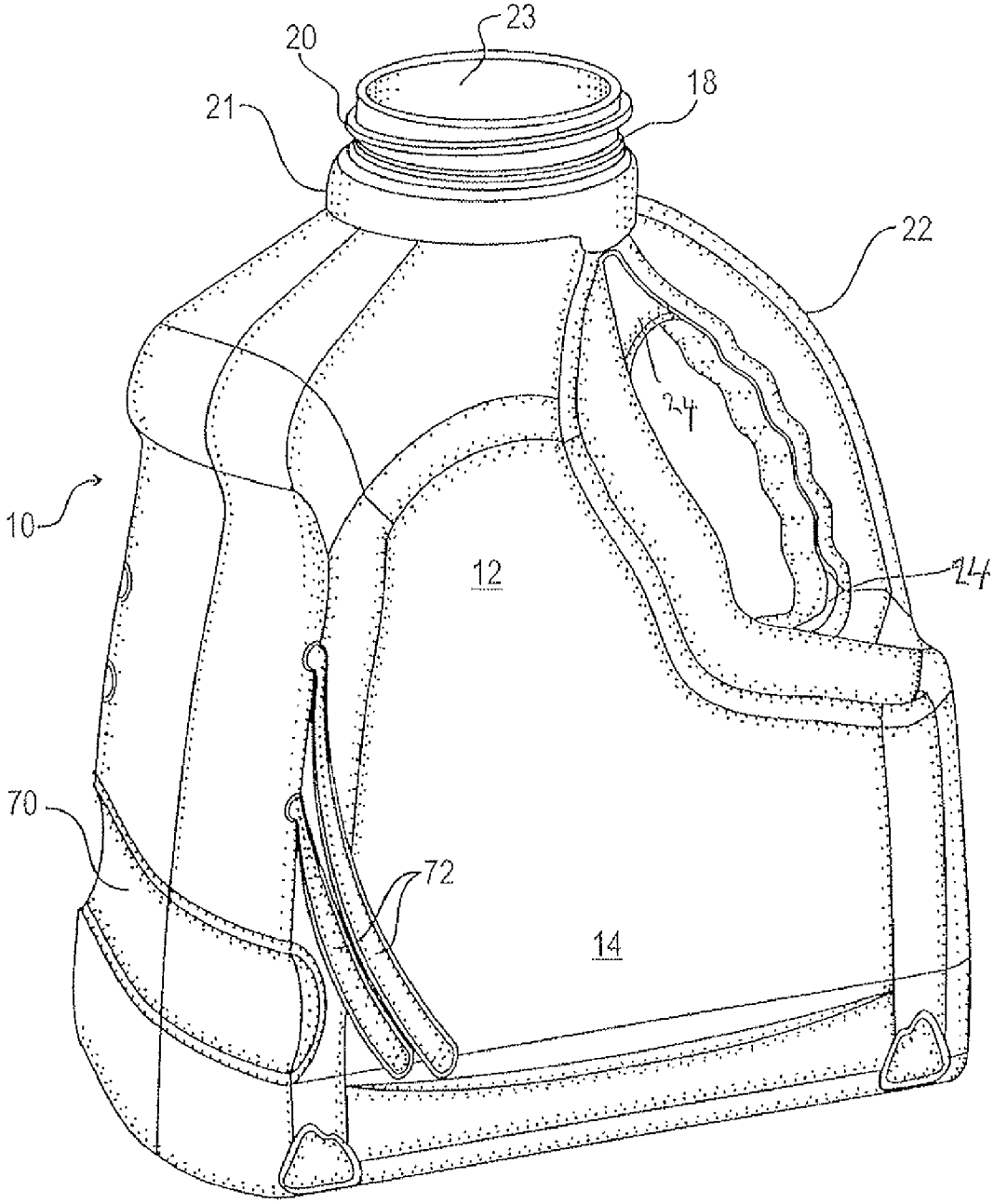
FIG. 2 is a perspective view of the bottle with cap removed.
Figure 7:
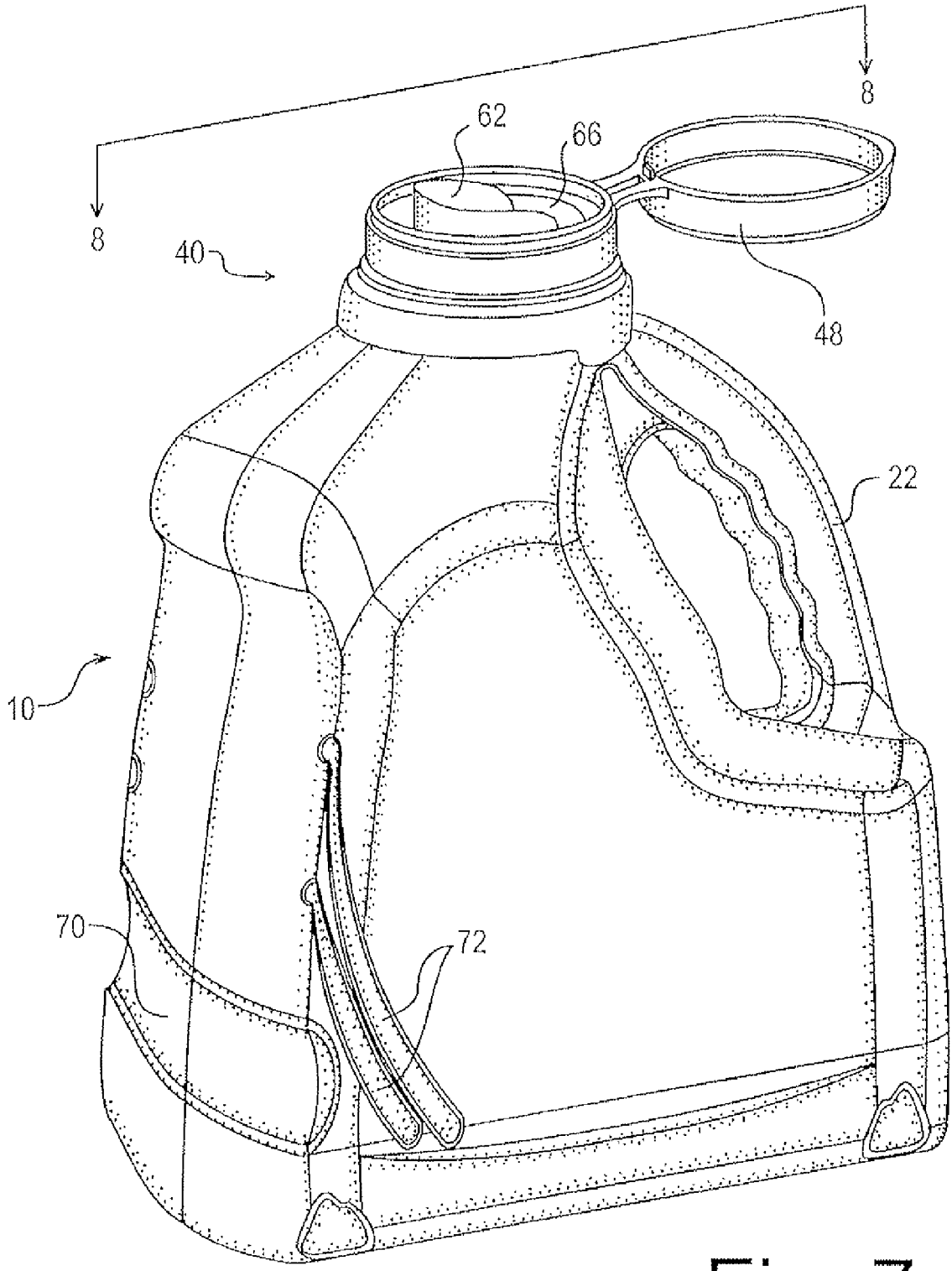
FIG. 7 is a perspective view of the bottle and cap combination.

FIGS. 1, 2 and 7 illustrate the recesses within the bottle 10 which improve the ergonomics to assist the user to grip the bottle, especially when the bottle is full. A first recess 70 comprises a scalloped indentation or groove having a rounded cross sectional profile, which extends fully across the front face 21 of the bottle adjacent the base 13. Additional recesses 72 are provided on opposed side faces 15 and 17 of the bottle 10. These recesses 72 are disposed at about a 45 degree angle and extend upwardly from adjacent the base of the bottle 10, towards the front face 21. Preferably, paired generally parallel recesses 72 are provided which curve along their length for improved ergonomics.

The present invention has been described herein by way of illustrated embodiments thereof, including numerous particulars and details. However, one skilled in the art will readily understand that numerous variations may be made to the examples described herein, without departing from the scope of the present invention. The full scope of the present invention is described and characterized by the present patent specification as a whole, including the patent claims included within this specification. Elements described herein may be substituted by their obvious mechanical or functional equivalents without departing from the invention.

The invention claimed is:

1. A bottle and cap combination, said bottle comprising a hollow body having a lower body portion and an upper body portion terminating in a bottle neck, and a handle having a hollow interior forming an air conduit, said handle having upper and lower ends joining with said upper and lower body portions respectively of said container body, the hollow interior of said handle forming an air passageway having upper and lower ends for communicating with the interior of said body to permit a flow of air entering said bottle to flow through said handle into said lower portion of said container body; said cap comprising a flat upper surface with an opening comprising at least partially separated first and second regions therein, said first region comprising an outlet for dispensing liquid from the bottle and said second region comprising an air inlet to admit air into the interior of said bottle as the liquid is poured through said first region, wherein said second region comprises an arcuate slot partially surrounding said first region, and a wall extending upwardly from said surface at least partially surrounding the first region to form a pour spout, said wall at least partially separating the first and second regions whereby at least a portion of the first and second regions are located on opposing sides of said wall, said bottle and cap configured to align said second region with said handle when said cap is engaged to said bottle whereby air entering said second region flows into said upper air passageway of said handle during pouring.

2. The combination of claim 1, wherein said cap is removable from said body.

3. The combination of claim 1 further comprising alignment means to align said second region with said handle when said cap is engaged to the bottle, whereby during pouring a flow of air may pass through said second region into the hollow interior of said handle.

4. The combination of claim 1 wherein said wall includes a gap between said first and second regions, said regions being continuous through said gap.

5. The combination of claim 1, wherein said wall angles upwardly away from said second region.

6. The combination of claim 1, wherein said container body includes a recessed portion to provide an open space between said body and said handle.

7. The combination of claim 1 wherein said bottle further includes at least one recess within said bottle at a location opposed to said handle, configured for gripping the bottle during pouring.

8. The combination of claim 1 wherein said cap comprises an openable lid which when closed, effectively seals said regions.

9. The combination of claim 1 wherein said bottle further includes a collar region adjacent to the base of said neck, said collar region having a cross sectional diameter wider than said neck, said air passageway communicating with the interior of said collar portion.

10. A cap for attachment to a bottle having an interior, said cap comprising a tubular skirt and substantially planar upper surface, an opening within said surface comprising a first region for dispensing liquid from the bottle and a second region comprising an air inlet to admit air into the interior of the bottle as the liquid is poured through said first region, and a wall extending upwardly from said surface at least partially surrounding the first region to form a pour spout, said wall at least partially separating the first and second regions whereby at least a portion of the first and second regions are located on opposing sides of said wall, wherein said wall includes a gap between said first and second regions, said regions being continuous through said gap.

11. A cap as defined in claim 10, wherein said first region is generally oval-shaped with opposed narrow ends, said second region partially surrounding one of said narrowed ends of said first region.

12. A cap as defined in claim 10 further comprising an openable lid which when closed, effectively seals said regions.

13. The combination of claim 3, wherein said alignment means comprises a screw-threaded attachment between said bottle and cap configured to form said alignment when said cap is snugly screwed to said bottle.

14. The cap of claim 10, said second region comprising an arcuate slot partially surrounding said first region.

* * * * *